US005277344A

United States Patent [19]

Jenkins

[11] Patent Number: 5,277,344

[45] Date of Patent: Jan. 11, 1994

[54] FLOW CONTROL DEVICE FOR FLUID DISPENSER

[75] Inventor: Thomas C. Jenkins, Amherst, Ohio

[73] Assignee: Nordson Corporation, Westlake, Ohio

[21] Appl. No.: 956,795

[22] Filed: Oct. 5, 1992

[51] Int. Cl.[5] ..... G01F 11/06

[52] U.S. Cl. ..... 222/504; 222/518; 222/559

[58] Field of Search ..... 222/504, 518, 559

[56] References Cited

U.S. PATENT DOCUMENTS

| | | | |
|---|---|---|---|
| 2,622,765 | 12/1952 | Gilmont . | |
| 2,893,130 | 7/1959 | Ierokomos . | |
| 3,094,254 | 6/1963 | Cullen et al. . | |
| 3,690,518 | 9/1972 | Baker et al. . | |
| 3,811,601 | 5/1974 | Reighard et al. | 222/504 X |
| 4,801,051 | 1/1989 | Lewis et al. | 222/504 X |
| 4,953,756 | 9/1990 | Breault et al. | 222/518 X |
| 5,097,993 | 3/1992 | Davis | 222/559 X |

FOREIGN PATENT DOCUMENTS

| | | |
|---|---|---|
| 1152465 | 3/1982 | Canada . |
| 3108793 | 9/1982 | Fed. Rep. of Germany . |
| 973983 | 11/1982 | U.S.S.R. . |
| 354006 | 8/1931 | United Kingdom . |
| 1214863 | 12/1970 | United Kingdom . |

*Primary Examiner*—Kevin P. Shaver
*Attorney, Agent, or Firm*—Wood, Herron & Evans

[57] ABSTRACT

A flow control device for a fluid dispenser provides independent adjustment and control of both stroke length and spring load of a needle valve which ultimately controls outward flow from a nozzle. Independent adjustment and control of stroke length and spring load enable an operator to independently set the dispensing gap which is directly proportional to dispensing rate, and the closing force of the needle valve so that a single dispenser may be used for dispensing materials of different viscosity. An axially movable stop member is aligned with a piston carried by the needle valve. A compression spring circumscribes the stop member, and a cylindrical retainer surrounds the compression spring. An axially adjustable screw holds the retainer in place, thereby holding the spring in compression between the retainer and the piston. The axial positions of the stop member and the retainer may be adjusted independently to independently set stroke length and closing force.

8 Claims, 1 Drawing Sheet

FLOW CONTROL DEVICE FOR FLUID DISPENSER

FIELD OF THE INVENTION

This invention relates to a flow control device for a fluid dispenser of the type used to dispense relatively viscous sticky substances, such as adhesives, hot melts, sealing compounds, etc. More particularly, this invention relates to a flow control device which provides improved accuracy and repeatability in the control and adjustment of dispensing parameters.

BACKGROUND OF THE INVENTION

A typical hot melt dispenser provides for fluid flow through a body cavity and then out a nozzle orifice toward a substrate or work-piece. A needle valve located inside the dispenser body seats within a valve seat formed by the nozzle orifice, thereby preventing flow of the dispensing fluid out of the nozzle orifice. Movement of the needle valve away from the valve seat permits fluid flow out of the nozzle orifice at a rate commensurate with the dimensions of the gap between the needle valve and the valve seat.

It is desirable to accurately and adjustably control the flow of dispensing fluid through the nozzle orifice. For a given gap size between the needle valve and the valve seat, the dispensing rate will vary with the viscosity of the material being dispensed. To accurately control dispensing rate for materials having a wide range of viscosities without requiring time consuming nozzle changes, it is desirable for a fluid dispenser to provide reliable and repeatable control and adjustment of the gap between the needle valve and the valve seat.

Typically, the needle valve for dispensers of this type carries a piston at an end opposite the valve seat. The piston is centered within the body, and the application of pressurized air on one face of the piston causes the needle valve to move away from the valve seat.

To set a maximum gap between the needle valve and the valve seat, i.e., a maximum stroke distance, a stop member is housed within the body, in alignment with the piston. The stop member limits the travel distance of the piston, and hence the gap between the needle valve and the valve seat during dispensing. By providing for adjustment of the position of the stop member with respect to the piston, the maximum gap between the needle valve and the valve seat may be varied. Thus, adjustment of the position of the stop member enables a single dispenser to be used with materials which vary in viscosity.

To prevent undesired dispensing of fluid and to maintain maximum control of fluid dispensing, the needle valve is biased to a closed position. This biasing force is usually supplied by a compression spring which acts upon a face of the piston opposite the face acted upon by the pressurized air. The biasing force applied to the piston determines the closing force of the needle valve when dispensing ceases. It is necessary for the spring to maintain a sufficiently high closing force on the piston to effectively terminate dispensing with little or no dripping. Because the closing force will vary with the viscosity of the material being dispensed, it is also desirable to provide for adjustment of this applied biasing force, i.e. the spring load.

Thus, it is desirable to provide adjustability for the stop member of a fluid dispenser to control the stroke distance of the needle valve, thereby to achieve a desired flow rate for materials of varying viscosity. At the same time, it is also desirable to provide adjustability for the spring load used to bias the needle valve to a closed position.

Applicant's U.S. Pat. No. 4,801,051, entitled "Flow Control Devise for Fluid Dispensing Apparatus", and which is expressly incorporated by reference herein in its entirety, discloses a device which provides for microadjustment of the stroke length of a hot melt dispensing module. This device provides for adjustment of both stroke length an closing force to enable a single dispensing gun to be used with materials of different viscosities.

However, because of the structural arrangement of the stop member and the compression spring of this dispenser, adjustment of the position of the stop member also affects the spring load, while adjustment of the spring load affects the stroke length. As a result, it is difficult to simultaneously quantify both of these parameters, i.e., closing force and gap size, to achieve predetermined and predictable results in dispensing fluids of varying viscosity from a single dispensing gun. Typically, after changing over to a different dispensing fluid, an operator must run several tests to verify that the adjustable settings of stroke length and spring load produce the desired result.

It is an object of this invention to eliminate guesswork commonly associated with setting and controlling the gap size and the closing force of a needle valve of a fluid dispenser.

It is another object of this invention to enhance accuracy and predictability in dispensing fluids of varying viscosity from a single liquid dispenser.

This invention meets the above-stated objectives by structurally isolating compression spring adjustment components from stop member adjustment components within the body of a fluid dispenser so that the closing force and the gap size of the needle valve can be independently controlled.

Because this invention provides for independent control of the closing force and the gap size of a fluid dispenser, these two parameters may be accurately quantified and repeated so that optimum dispensing is achieved with a single dispenser, regardless of variation in the viscosities of the materials dispensed.

This invention eliminates the guesswork formerly associated with simultaneous control of both closing force and gap size. The fluid dispenser of this invention enables an operator to select, for a material of known viscosity, both a desired gap size, i.e. determined by stroke length of the needle valve, and a desired closing force, i.e., determined by the biasing force applied to the needle valve by the compression spring.

To achieve independent control of both closing force and gap size, this invention contemplates an adjustable stop member aligned axially with the needle valve. Adjustment of the axial position of the stop member with respect to the radial center of a piston carried by the needle valve adjusts the maximum stroke distance of the needle valve, thereby setting the gap between the nozzle orifice and the needle valve.

A compression spring and the components which control the compression applied by the spring are located radially outside of the stop member, so that the spring acts upon the piston radially outside of, and independently of the stop member. The stop member extends axially through the compression spring and a cylindrical retainer which holds the compression spring in place.

According to a preferred embodiment of the invention, a fluid dispenser includes a body with an axial bore therethrough which terminates in a nozzle orifice. A needle valve located within the dispenser is aligned along the axis of the bore, and the needle valve carries a piston which is acted upon by pressurized air to move the needle valve away from the nozzle orifice to dispense fluid therethrough. A stop member is axially aligned with the center of the piston to limit travel of the needle valve away from the nozzle orifice. An upper end of the stop member threadably connects to an upper section of the body, which is bolted to a lower section of the body. Threadable adjustment of the stop member with respect to the piston varies the maximum stroke length of the needle valve.

A compression spring has one end which bears directly against the piston, outside of the stop member, and a cylindrical retainer located within the bore has a lip which bears against the opposite end of the spring. The retainer lip defines a circular passage through which the stop member extends. An adjustment screw spaced away from and parallel with the bore threadably connects to the body. The adjustment screw carries a washer which contacts the retainer to hold it in place. The axial position of the washer determines the axial position of the retainer with respect to the body, and the distance between the retainer lip and the piston determines the axial compression of the spring, and hence the compressive force applied to the piston by the spring. Adjustment of this screw adjusts the spring bias on the piston, thereby setting the closing force for the needle valve.

Because the stop member extends through the compression spring and the cylindrical retainer, adjustment of the axial position of the stop member, and thus the stroke length, does not affect the spring load applied to the piston. Moreover, because the spring and the retainer circumscribe the stop member, adjustment of the axial position of the retainer varies the spring load but does not affect the stroke distance of the needle valve.

Thus, this invention provides independent adjustment of the applied spring load and the stroke length of a needle valve of a liquid dispenser, thereby to improve accuracy in setting a desired closing force and a desired gap size for the needle valve during fluid dispensing. As a result of the independent adjustment capability for both stroke length and spring bias, a single dispenser may be used to accurately and repeatably dispense materials of varying viscosity.

These and other features of the invention will be more readily understood in view of the following detailed description and the drawings.

DETAILED DESCRIPTION OF THE DRAWINGS

Figure 1:
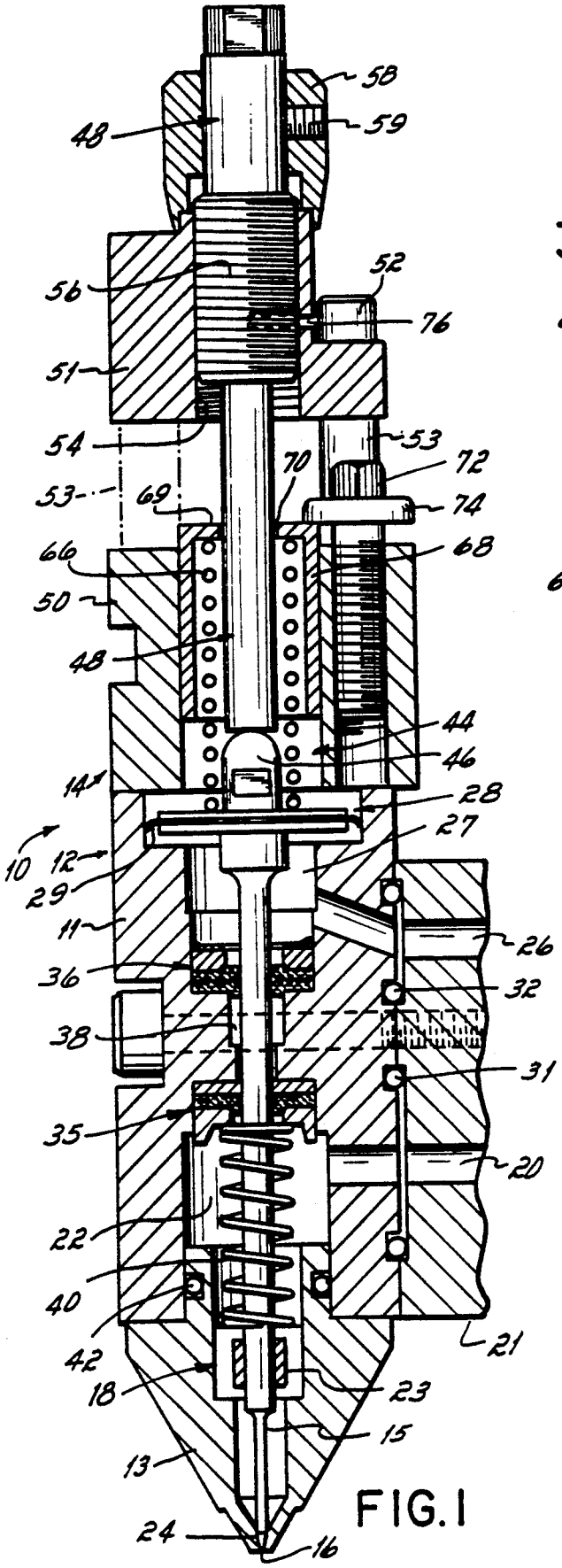
FIG. 1 is a cross-sectional view of a fluid dispenser in accordance with a preferred embodiment of the invention.

FIG. 1 depicts a fluid dispenser, or dispensing gun 10, constructed in accordance with a preferred embodiment of the invention. The gun 10 comprises an elongated body 11, which includes a lower section 12, a nozzle 13 connected to one end of the lower section 12 and an upper section 14 connected to an opposite end of the lower section 12. The body 11 has a longitudinal bore extending therethrough within which is located an axially movable needle valve 15 which ultimately controls the flow of liquid from an orifice 16 at the end of the nozzle 13.

A liquid passageway 20 extends through a manifold 21 and through the body 11 into a forward cavity 22. Liquid flows through the liquid passageway 20 into the cavity 22 and then through axially passageways 18 provided in a needle valve guide bushing 23, progressing through the orifice 16 when the needle valve 15 is unseated from a valve seat 24 formed in the orifice 16.

Movement of the needle valve 15 into and out of engagement with the valve seat 24 is accomplished pneumatically. Air inlet 26 in manifold 21 extends through the body 11 to admit air under pressure to a rearward cavity 27, where the air acts on a piston 28 to affect movement of the needle valve 15. The piston 28 includes a piston ring 29 which radially seals the rearward cavity 27 of the lower section 12. O-ring seals 31 and 32 are provided between the manifold 21 and the lower section 12. A forward seal assembly 35 and a rearward seal assembly 36 seal the liquid receiving forward cavity 22 and the air receiving rearward cavity 27, respectively. A weep hole 38 is provided between the seal assemblies 35 and 36 through which any air or liquid which seeps through the seal assemblies may be vented from the body 11. A forward spring 40 maintains the position of the forward seal assembly 35. An O-ring 42 provides a seal between the lower section 12 and the nozzle 13

Lower section 12 and upper section 14 of body 11 are preferably rectangular in cross section and connected together longitudinally by bolts (not shown) located at opposite corners. The upper section 14 includes an axial passageway 44 aligned with rearward cavity 27 and needle valve 15. A piston lock nut 46 with a domed top extends upwardly from a face of the piston 28 and into the axial passageway 44 of upper section 14. Upward movement of lock nut 46 is limited by an axially adjustable stop member 48 carried by upper section 14. Adjustment of the axial position of the stop member 48 with respect to the lock nut 46 and the piston 28 sets the maximum stroke distance for the needle valve 15, and hence the gap size during dispensing.

The upper section 14 includes a bottom piece 50 and a top piece 51 which are connected by bolts 52 which extend through sleeve-like spacers 53. The top piece 51 includes internal threads 54 which mesh with external threads 56 of the stop member 48. A knob or head 58 connects to an upper end of the stop member 48 and is held in place by a set screw 59. By grasping and rotating the knob 58 with respect to the top piece 51, the axial position of the stop member 48 can be adjusted, thereby setting the maximum stroke distance for the needle valve 15.

Figure 2:
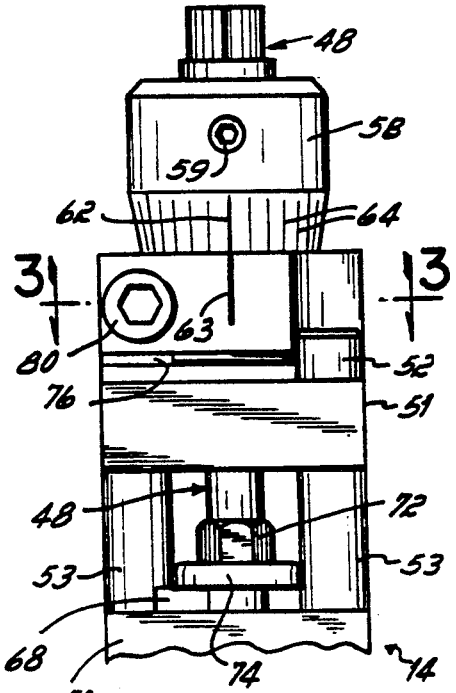
FIG. 2 is a side elevational view of an upper end of the fluid dispenser shown in FIG. 1.

As best shown in FIG. 2, the head 58 and the top piece 51 include reference markings 62 and 63, respectively, to establish a zero or initial position for the stop member 48. Head 58 also includes equidistantly spaced reference markings 64 which facilitate correlation of rotational movement of the head 58 to axially movement of the stop member 48. Preferably, the reference markings 62, 63, and 64 are formed by indentations.

Referring back to FIG. 1, a compression spring 66 is located within axial passageway 44, and the compression spring 66 surrounds the lock nut 46 and the stop member 48. A bottom end of the compression spring 66 contacts the piston 28, around the outside of lock nut 46. The compression spring 66 is located radially within a cylindrical retainer 68 which also resides within axially passageway 44. The cylindrical retainer 68 includes a lip 69 which bears against the top end of the compression spring 66. The lip 69 also defines a circular passage 70 through which the stop member 48 extends.

An adjustment screw 72 threads within the bottom piece 50 at a position spaced laterally away from and parallel with the axial passageway 44. A washer 74 carried by the screw 72 engages the lip 69, thereby limiting axial movement of the retainer 68 away from the orifice 16. Threadable rotation of the screw 72 adjusts the axial position of the washer 74 and the lip 69, thereby adjusting the spring force applied to the piston 28 by the compression spring 66. Tightening of the screw 72 increases the spring force applied by compression spring 66, and loosening of the screw 72 reduces the spring force applied by compression spring 66. Thus, the axial position of screw 72 with respect to bottom piece 50 sets the spring force on the piston 28, and hence the closing force applied by the needle valve 15.

Because the screw 72, the washer 74, the cylindrical retainer 68 and the compression spring 66 are located radially outside of the stop member 48 and the lock nut 46, adjustment of the spring load applied to the piston 28 does not affect the stroke distance of the needle valve 15. Rather, the applied spring load may be adjusted independently of the stroke distance. Moreover, because the stop member 48 coacts with the lock nut 46 in a manner which is independent of the components which determine the spring force, i.e., the screw 72, the washer 74, the retainer 68 and the compression spring 66, the stroke length may be adjusted independently of the spring force. Thus, with this invention, an operator is able to independently adjust the spring load and the stroke length to select and obtain a desired closing force and a desired dispensing gap.

Figure 3:
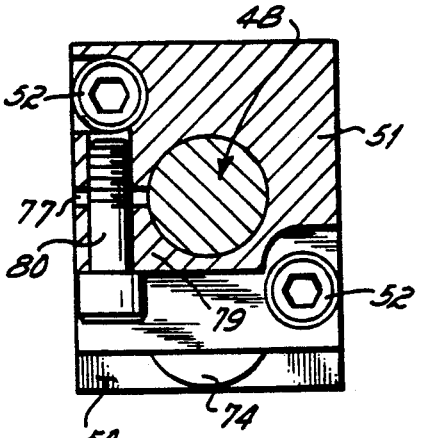
FIG. 3 is a cross-sectional view taken along lines 3—3 of FIG. 2.

FIG. 2 shows a bottom cut 76 in top piece 51, and FIG. 3 shows a side cut 77 in top piece 51 which together define a radially deflectable portion 79 of top piece 50. A set screw 80 spans the side cut 77. Tightening of the set screw 80 applies radially compressive force to the stop member 48 to secure the stop member 48 in a desired position with respect to upper section 14.

Thus, while the invention has been described in connection with certain presently preferred embodiments, those skilled in the art will recognize many modifications of structure, arrangement, portions, elements, materials and components which can be used in the practice of the invention without departing from the principals of the invention.

What is claimed is:

1. An improved flow control device for a fluid dispensing apparatus comprising:

a body with an axial bore therein and a nozzle communicating with one end of the bore having a nozzle orifice;

a needle valve axially movable within said axial body bore to open and close said nozzle orifice;

means for moving said needle valve within a said axial body bore, including spring means for applying a spring closing force against said needle valve to hold said needle valve in a closed position;

a stop member axially aligned with the needle valve and extending though the spring means, the stop member being axially movable in said body bore and having opposed ends, one end of said stop member forming an end stop to the movement of said needle valve away from the nozzle orifice;

first means for adjusting said spring closing force applied by said spring means;

second means for adjusting the maximum stroke length of the needle valve away from the nozzle orifice;

whereby adjustment of said first adjusting means does not affect the stroke length of the needle valve and adjustment of said second adjusting means does not affect said spring closing force.

2. The flow control device of claim 1 and further comprising:

a piston carried by the needle valve;

said first means for adjusting further comprising, a retainer located in said bore and axially movable therein, the spring means held in compression between the piston and the retainer, and means for holding the retainer a predetermined distance from the piston.

3. The flow control device of claim 2 wherein said holding means further comprises:

adjustable means supported by the body in spaced and parallel relationship with the needle valve; and limit means carried by the adjustable means, the limit means engaging and limiting axial movement of said retainer away from said orifice.

4. The flow control device of claim 2 wherein the retainer is cylindrical in shape and circumscribes said spring means.

5. A flow control device for a dispenser comprising:

a body having an axial bore therethrough, the bore terminating in an orifice;

a needle valve extending through the bore and axially movable within the bore to open and close the orifice;

means for axially moving the needle valve away from the orifice to an open position;

means for limiting maximum travel of the needle valve away from the orifice;

means for spring biasing the needle valve to a closed position;

first means for independently adjusting the spring biasing means without affecting the limiting means; and second means for independently adjusting the limiting means without affecting the spring biasing means.

6. The flow control device of claim 5 wherein the first means for independently adjusting is located radially outside of the second means for independently adjusting.

7. The flow control device of claim 5 wherein the second means for independently adjusting includes a stop member aligned axially with the needle valve.

8. A flow control device for a fluid dispenser comprising:

a body having a fluid passageway terminating in an orifice;

an axially movable needle valve located in the body and having an end seated within the orifice, whereby axial movement of the valve opens and closes the orifice to allow and prevent fluid flow therethrough;

means for applying a spring biasing force to the needle valve to hold the needle valve in a closed position;

means for limiting the movement distance of the needle valve away from the orifice;

means for adjusting the applying means to adjust the spring biasing force independently of the movement distance set by the limiting means; and means for adjusting the limiting means to adjust the movement distance independently of the spring biasing force.

* * * * *